US011002092B2

(12) United States Patent
McLeod

(10) Patent No.: US 11,002,092 B2
(45) Date of Patent: May 11, 2021

(54) DEVICE FOR FACILITATING THE TRANSPORT OF AN APPARATUS ALONG AN UPWARD OR A DOWNWARD DIRECTED CONDUIT OR BOREHOLE

(71) Applicant: AUSTRALIAN MUD COMPANY PTY LTD, Balcatta (AU)

(72) Inventor: Gavin McLeod, Attadale (AU)

(73) Assignee: Australian Mud Company Pty Ltd, Balcatta (AU)

( * ) Notice: Subject to any disclaimer, the term of this patent is extended or adjusted under 35 U.S.C. 154(b) by 28 days.

(21) Appl. No.: 16/344,102

(22) PCT Filed: Oct. 26, 2017

(86) PCT No.: PCT/AU2017/051183
§ 371 (c)(1),
(2) Date: Apr. 23, 2019

(87) PCT Pub. No.: WO2018/076066
PCT Pub. Date: May 3, 2018

(65) Prior Publication Data

US 2019/0323309 A1 Oct. 24, 2019

(30) Foreign Application Priority Data

Oct. 26, 2016 (AU) ..... 2016904356

(51) Int. Cl.
*E21B 23/10* (2006.01)
*E21B 21/10* (2006.01)

(52) U.S. Cl.
CPC ..... *E21B 23/10* (2013.01); *E21B 21/10* (2013.01)

(58) Field of Classification Search
CPC ..... E21B 23/10; E21B 21/10; E21B 21/08; E21B 25/16; E21B 25/02
See application file for complete search history.

(56) References Cited

U.S. PATENT DOCUMENTS 5,020,612 A † 6/1991 Williams
6,425,449 B1 † 7/2002 Marshall
(Continued)

*Primary Examiner* — David J Bagnell
*Assistant Examiner* — Yanick A Akaragwe
(74) *Attorney, Agent, or Firm* — Felix L. Fischer

(57) ABSTRACT

A device (10) for facilitating the transport of an apparatus A along an upward or downward directed conduit or bore hole including a drill string (12) is described. The device (10) has a body (13) having an upper body portion (20) and a lower body portion (22) which are coupled together and movable axially relative to each other. A fluid flow path (58) internal of the body (13) selectively enables fluid to flow through the body (13). A first valve system 60 located at a first end of the internal fluid flow path (58) is operable by a pressure differential between a region external of the body (13) and the internal fluid flow path (58). A second valve system (51) is located at second end of the internal fluid flow path. The second valve system (51) is operable by relative movement between the upper body portion (20) and lower body portion (22). One or more openings (56) are provided at an end of the body (13) downstream of the first valve system (60) through which fluid can flow or fluid pressure can be communicated to an apparatus A being transported by the device (10).

16 Claims, 5 Drawing Sheets

(56) References Cited

U.S. PATENT DOCUMENTS

| | | | | |
|---|---|---|---|---|
| 6,564,885 | B2 † | 5/2003 | Attwater | |
| 2014/0353044 | A1 † | 12/2014 | Lambert | |
| 2016/0123101 | A1 * | 5/2016 | Attiwell | E21B 23/10 175/57 |
| 2019/0024468 | A1 * | 1/2019 | McLeod | E21B 47/024 |

* cited by examiner
† cited by third party

DEVICE FOR FACILITATING THE TRANSPORT OF AN APPARATUS ALONG AN UPWARD OR A DOWNWARD DIRECTED CONDUIT OR BOREHOLE

REFERENCES TO RELATED APPLICATIONS

This application is a national stage filing under 35 U.S.C. 371 and claims priority of International Application serial no. PCT/AU2017/051183 having an international filing date of 26 Oct. 2017 which in turn claims priority of Australian patent application serial no. 2016904356 filed on 26 Oct. 2016, the disclosures of which are incorporated herein by reference.

TECHNICAL FIELD

A device is disclosed for facilitating the transport of an apparatus along an upward or a downward directed conduit or borehole. The device and method may for example have application in transporting an apparatus through a drill string which is being used to drill and upward or a downward directed borehole.

BACKGROUND ART

In many mining and civil engineering activities it is necessary to transport an apparatus or tool along a conduit such as a drill string or a borehole. Non limiting examples of such apparatus or tool include: an inner core barrel for a core drill; a greasing tool; and, a data logging system. The conduit or borehole can extend with a positive, neutral or negative gravity gradient. A borehole with a positive gravity gradient is one in which a toe of the borehole is at a vertical depth greater than a collar of the borehole; whereas a borehole with a negative gravity gradient is one where the toe of the hole is vertically above the collar of the hole. A neutral gravity gradient borehole is one that extends horizontally. With reference to the horizontal plane the negative gravity gradient borehole is one that is inclined above the horizontal travelling from the collar to the toe; whereas the positive gravity gradient borehole is one that is inclined below the horizontal travelling from the collar to the toe.

When it is necessary to transport an apparatus down a positive gravity gradient borehole is often possible to rely on gravity to provide the motive force. However when the borehole holds a volume of water or other liquid the speed of transport can be substantially reduced due to the need for the liquid to in effect flow between the outer surface of the descending apparatus and the surface of the borehole.

Of course when transporting an apparatus up a negative gradient borehole one must provide a force which continually acts on the apparatus to transport it toward the toe of the borehole and against the action of gravity. This can be achieved by attaching a plug like adapter to an up hole end of the apparatus and subsequently pumping water into the borehole to push the apparatus up the borehole. However the same plug like adapter is generally not suitable for use with the positive gravity gradient borehole because it reduces fluid bypass when descending and substantially increases the time taken to deliver the apparatus to the toe.

SUMMARY OF THE DISCLOSURE

In one aspect there is disclosed a device for facilitating the transport of an apparatus along an upward or downward directed conduit or bore hole comprising:

a body having an upper body portion and a lower body portion which are coupled together and movable axially relative to each other;

a fluid flow path internal of the body selectively enabling fluid to flow through the body;

a first valve system located at a first end of the internal fluid flow path, the first valve system being operable by a pressure differential between a region external of the body and the internal fluid flow path;

a second valve system located at second end of the internal fluid flow path, the second valve system being operable by relative movement between the upper body portion and lower body portion; and one or more openings at an end of the body downstream of the first valve system through which fluid can flow or fluid pressure can be communicated to an apparatus being transported by the device.

In one embodiment the second valve system comprises one or more radial ports, and the second valve system is arranged to close the one or more radial ports and the upper and lower body portions are moved relatively toward each other, and arranged to open the one or more radial ports when the upper and lower and lower body portions are moved relatively away from each other.

In one embodiment the second valve system comprises a sleeve coupled to the upper body portion and slidably retained within the second body portion, the sleeve movable to an open location where the sleeve uncovers the one or more radial ports to allow a flow of liquid there through, and a close location where the sleeve covers the one or more radial ports to prevent a flow of liquid there through.

In one embodiment the first valve system comprises a valve member and the valve seat and wherein when the pressure differential is at a first level the valve member seats on the valve seat to close the first valve system and when the pressure differential is at a second level greater than the first level the valve member is arranged to pass through the valve seat to open the first valve system enabling fluid to flow through the first valve system toward the one or more openings at the end of the body downstream of the first valve system.

In one embodiment the device comprises a sealing mechanism removably connectable to the body and arranged to form a liquid seal between the device and a conduit or borehole through which the device travels.

In one embodiment the sealing mechanism is disposed on the body at location between the first valve system and the second valve system.

In one embodiment when the pressure differential is at the second level liquid upstream of the sealing mechanism is able to flow into the internal flow path by passing the sealing mechanism.

In one embodiment when the pressure differential is at the second level and the second valve system is closed liquid upstream of the sealing mechanism is up to flow through the internal flow path bypassing the sealing mechanism and flowing or communicating fluid pressure through the one or openings end of the body downstream of the first valve system.

BRIEF DESCRIPTION OF THE DRAWINGS

Notwithstanding any other forms which may fall within the scope of the device as set forth in the Summary, specific embodiments will now be described, by way of example only, with reference to the covering drawings in which.

DETAILED DESCRIPTION OF SPECIFIC EMBODIMENTS

Figure 1:
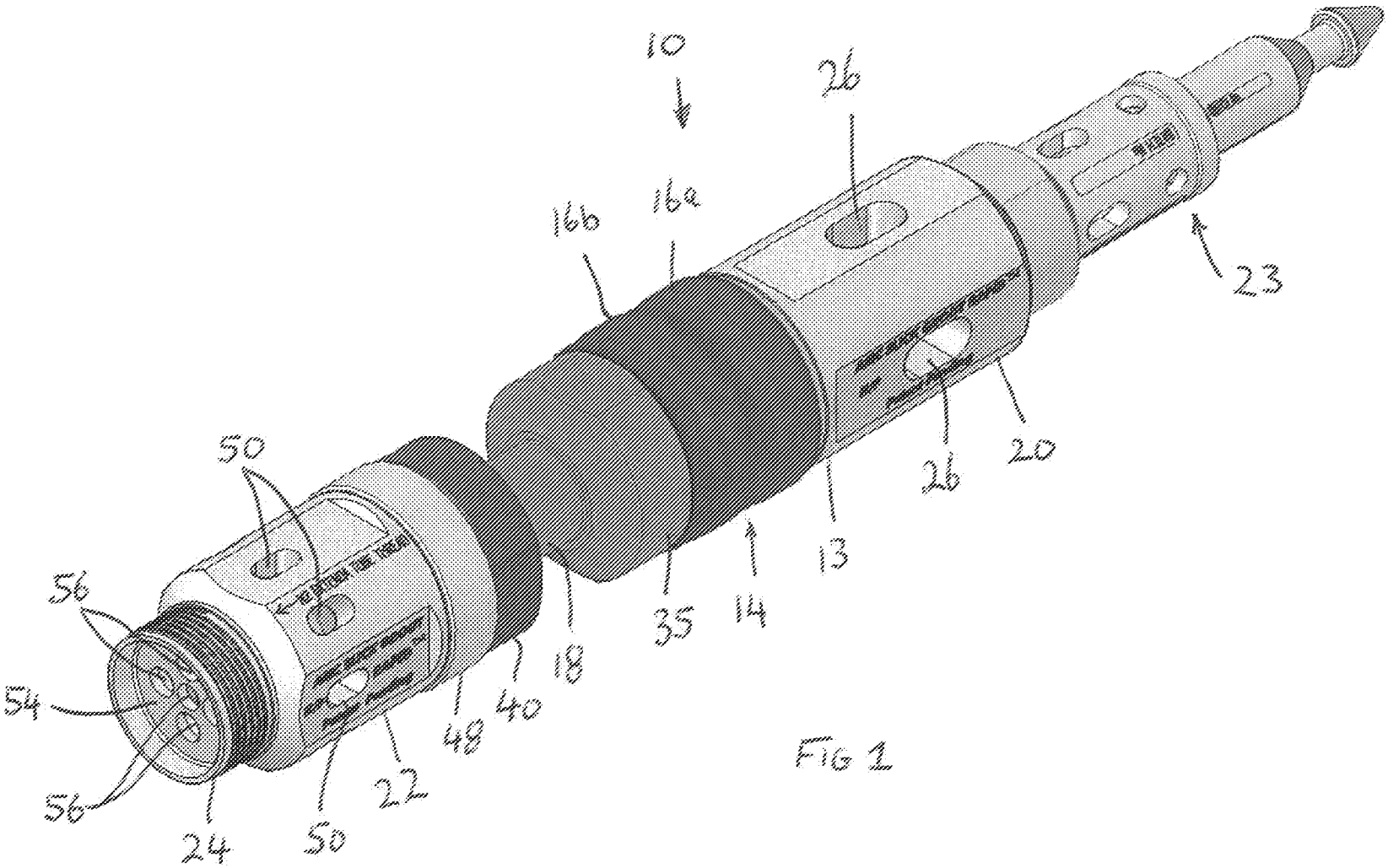
FIG. 1 is a schematic representation of an embodiment of the disclosed device that may be used for facilitating the transport of an apparatus or system along a drill string or borehole.

FIGS. 1-8 depict an embodiment of the disclosed device 10 that can be used to facilitate transport of an apparatus along a conduit or boreholes that extends with a positive, neutral or negative gravity gradient. For the sake of simplicity the device 10 will be described with reference to transporting an apparatus through a conduit in the form of a drill string. However it is to be understood that structure and operation of the disclosed device 10 is independent of the nature of the conduit or borehole within which it is used.

In the following discussion of the device 10, irrespective of the gradient of the drill sting, the term "downstream direction" with reference to a direction from a collar of a borehole in which the drill string is located to the toe of the borehole in which the drill string is located. Thus for a drill string having a drill bit at one end and connected to a machine at an opposite end the downstream direction is a direction toward the drill bit. The term "upstream direction" is the direction from the toe of the borehole in which the drill string is located toward the collar of the borehole. Thus the upstream direction is a direction away from the drill bit. The term "downhole end" or "downstream end" means the end of the drill string having the drill bit; and the term "up hole end" or "upstream end" means the end of the drill string distant the drill bit.

The device 10 can operate as a seal that can be selectively bypassed. When the device 10 is in a pump-in mode or configuration (which is depicted if FIG. 2) it acts as a seal against the inner circumferential surface of a drill string 12 (shown in FIG. 3 only). Accordingly full pressure of fluid pumped into the drill string 12 upstream of the device 10 is applied to the body of the device 10 forcing it down the drill string 12 toward a toe of the corresponding borehole being drilled by the drill string 12. This is particularly beneficial when the borehole has a shallow or negative gravity gradient where the action of gravity by itself is not sufficient to cause, or is acting against, movement of the device 10 (and any connected apparatus) to advance toward the downhole end of the drill string 12.

The device 10 also has an injection or bypass mode (shown in FIG. 4) in which the fluid pumped into the drill string 12 is able to bypass the seal, and flow internally of the device 10. This fluid may then operate the apparatus to which it is attached.

The device 10 has a body 13 on which is mounted a sealing mechanism 14. The sealing mechanism 14 years in the form of annular washers 16*a*, and 16*b* (hereinafter referred to in general as "washers 16"). The washers 16 are provided with circumferential skirts or flaps 17 that are able to inflate or otherwise deflect outwardly in responses to upstream fluid pressure.

The body 13 is formed from several major components which are coupled together. These components include a stem 18, an upper body portion 20 and a body portion 22 which are coupled together by the stem 18. The upper and lower body portions 20 and 22 are axially movable relative to each other. A spear point 23 is connected to the upper body portion 20. A downhole end of the lower body portion 22 is provided with an externally threaded boss 24 which, with reference to FIG. 3, would screw into the up hole end of the attached apparatus.

The upper body 20 is formed with a plurality of radially extending first ports 26. The first ports 26 lead to an internal axial passage 28. The up hole end of the stem 18 is connected to the internal axial passage 28. A valve seat 30 is retained in the stem 18 at an end adjacent the upper body 20. The valve seat 30 is configured to seat a valve member in the form of a ball 32.

The stem 18 is formed with a central axial passage 34 that extends from the valve seat 30 to a location inside of the lower body 22. A circumferential shoulder 35 is formed about the stem 18 intermediate of its length. The washers 16 which form the sealing mechanism 14 are retained between the shoulder 35 and the upper body 20.

The downhole end of the stem 18 is connected to a sleeve 36. The sleeve 36 has an axial passage 38 and is able to slide axially within the body 22. A cap 40 couples the stem 18 and the sleeve 36 to the body 22. The cap 40 is formed with a central passage 42 through which the stem 18 passes. The passage 42 has an increased inner diameter portion 44 creating an internal shoulder 46. A ring 48 is retained between the cap 40 and the lower body 22. The function of the ring 48 is to assist in centralisation of the device 10 within the drill string 12. The ring 48 can be replaced by unscrewing the lower body 22 from the cap 40.

The body 22 is formed with a plurality of radially extending second ports 50. The ports 50 lead to a central passage 52. An internal shoulder 53 is formed in the body 22 on a downhole side of the ports 50. A wall 54 extends across a downhole end of the passage 52. The wall 54 is formed with one or more, and in this case a plurality, of openings 56.

The device 10 has an internal flow path 58 (shown as a dashed line). Internal flow path 58 when opened allows fluid to bypass the sealing mechanism 14. The combination of the valve seat 30 and the valve ball 32 forms a first valve system 60. The first valve system 60 is located at a first end of the internal fluid flow path 58 and is operable by a pressure differential between a region external of the body 10 and the internal fluid flow path 58. For example if the fluid pressure acting on the valve ball 32 from within the body 13 in the fluid flow path 58 is greater than the pressure of fluid acting on the valve all 32 in a region between an outside of the body 13 on the inside of the drill string 12, then the first valve system 60 will be open with the ball 32 located off the seat 30. More generally, when the pressure differential is at a first level the valve member/ball 32 seats on the valve seat 30 to close the first valve system 60 and when the pressure differential is at a second level greater than the first level the valve member 34 is arranged to pass through the valve seat 30 to open the first valve system 60 enabling fluid to flow through the first valve system toward the openings 56.

Figure 2:
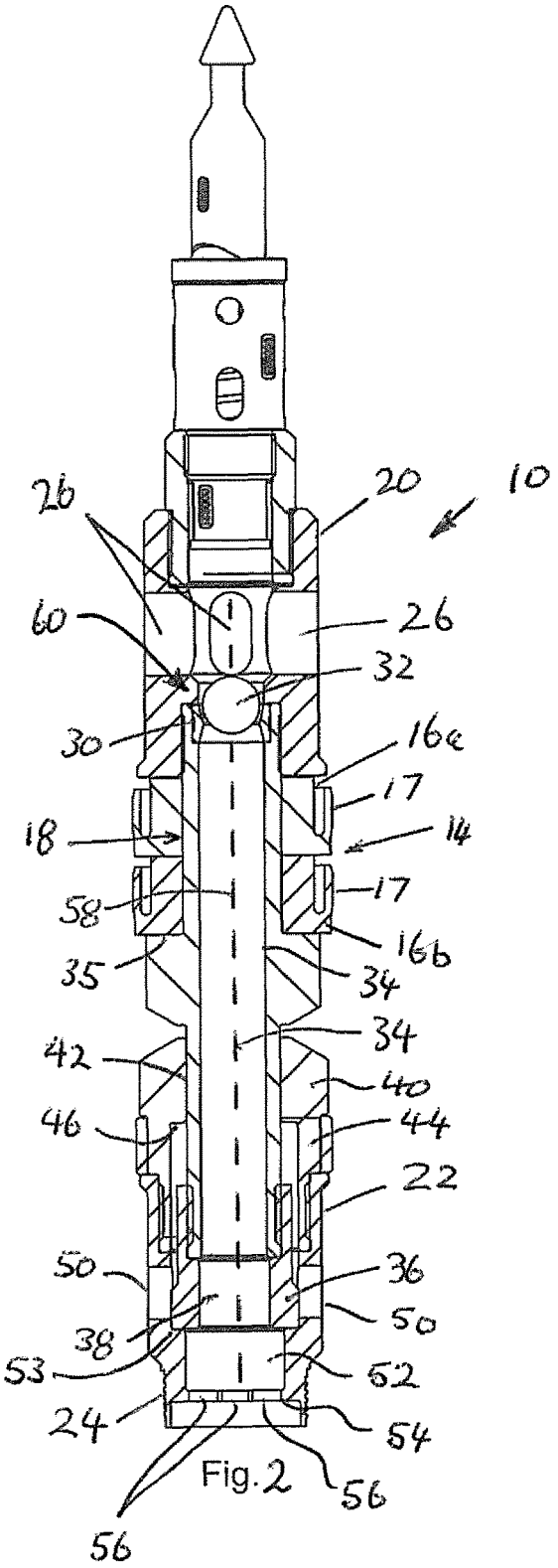
FIG. 2 is a section view of the device shown in FIG. 1 when in a pump-in mode.

The device 10 has a pump in mode or configuration shown in FIG. 2 when the valve system 60 is closed by the ball 30 being seated on the seat 32 so that liquid cannot flow through the internal flow path 58 is closed by action of the valve ball 30 been retained on and closing the upstream end of the valve seat 32. The device 10 has a bypass mode or configuration (which may also be referred to as an "open and state" shown in FIG. 4) in which the internal flow path 58 is open allowing fluid to flow internally of the device 10 bypassing the sealing mechanism 14. The bypass mode may also be equivalently referred to as a "flow through" mode when the adaptor 10 is attached to an apparatus A, shown in FIG. 4. The reason for this is that when the valve system 60 is in the bypass mode fluid is able to flow through the device 10, in particular the openings 56 to perform functions such as operating the attached apparatus A. In one possible application the apparatus A may be arranged to inject a flowable substance into the drill string and associated borehole when acted upon by the fluid pressure communicated through the device 10 and openings 56.

Figure 3:
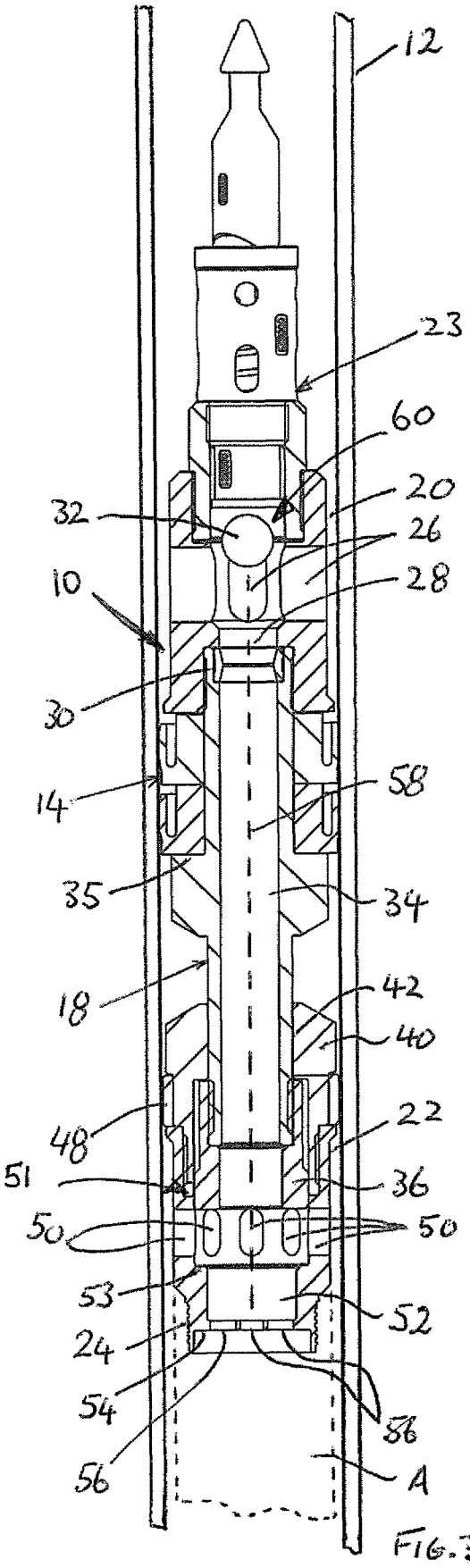
FIG. 3 is a section view of the device shown in FIG. 1 when in a freefall mode.

The device 10 also has a freefall mode which shown in FIG. 3. When the device 10 is in the freefall mode when it is either falling, or, sinking down a liquid filled drill string 12 and the valve ball 32 is on an up hole side of the valve seat 30. In this scenario as the device 10 travels down the drill string 12 fluid is able to enter through the ports 50 and travel through the stem 18 out through the valve seat 30 and the ports 26. The flow of fluid pushes the valve ball 32 off the valve seat 30. During the freefall mode the skirts/flaps 17 are not inflated. Nevertheless the sealing mechanism 14 is maintained in sealing contact with the inner circumferential surface of the drill string 12 preventing the bypass of fluid. (When the device 10 is in use connected to the apparatus A shown via the thread on the boss 24, the openings 56 lead into the inside of the apparatus A and therefore are not freely exposed to enable the direct inward flow of fluid into the openings 56.)

The device 10 can be switched between the pump-in mode (FIG. 2) and the bypass/flow through mode by increasing fluid pressure acting upstream of the valve system 60 to exceed a threshold pressure. When this pressure is exceeded valve ball 32 passes through the valve seat 30 and travels through the passage 34 settling on the wall 54, as shown for example in FIGS. 4 and 5. The valve seat 30 and/or the valve ball 32 can be interchanged to enable a variation of the threshold pressure. In one convenient form the seat 30 is made of a resilient material with an opening of a diameter less than the diameter of the valve ball 32. When the fluid pressure exceeds the threshold pressure the seat 30 resiliently expands increasing the diameter of its opening to enable the valve ball 32 to pass through.

The operation of the device 10 will now be described in the context of being attached to the apparatus A which holds a supply of a flowable substance (not shown) and is being transported to a downhole end of the drill string 12 to inject the flowable substance in the region of a toe of a negative gravity gradient borehole.

Pump-in Mode

The ensemble of the device 10 with the attached apparatus A is inserted into an up hole end of the drill string 12. The device 10 is initially in the freefall mode shown in FIG. 3 where the valve ball 32 is free to move within the axial passage 28 on the up hole side of the valve seat 30. (This is because when in a negative gravity gradient borehole/drill string gravity spent 0.23 is vertically below the apparatus A and therefore gravity acts on the ball 32 so that it falls off the seat 30.)

A fluid such as water is now pumped into the drill string 12. The sealing mechanism 14 forms a substantial fluid seal against the inner circumferential surface of the drill string 12. The pressure of the water inflates the side skirts 17 enhancing the sealing effect against the inner circumferential surface of the drill string 12. While the water is unable to pass the sealing mechanism 14 it is able to flow into the first ports 26. The resultant water pressure pushes the valve ball 32 onto the valve seat 30 thereby closing the internal flow path 58. Additionally, if not already in this configuration, the water pressure will cause the stem 18 and sleeve 36 to slide in a downhole direction relative to the body 22 so that the sleeve 36 abuts the shoulder 53 closing the ports 50 for example as shown in FIG. 2. The sleeve 36 and the ports 50 together form a second valve system 51. The second valve system 51 is at an opposite end of the internal flow path 58 with reference to the first valve system 60. The valve system 51 is in the closed condition when in the pump in mode as shown in FIG. 2 preventing flow of fluid regularly out from the ports 50.

During this time the pressure of the water is maintained below the threshold pressure required to cause the valve 60 to open. Therefore the net effect of the water pressure is to push the device 10 and thus the connected apparatus A along within the drill string 12 toward the down hole end of the drill string 12 and the toe of the corresponding borehole. During this period no water or water pressure can be communicated through the openings 56 into the apparatus A.

Figure 4:
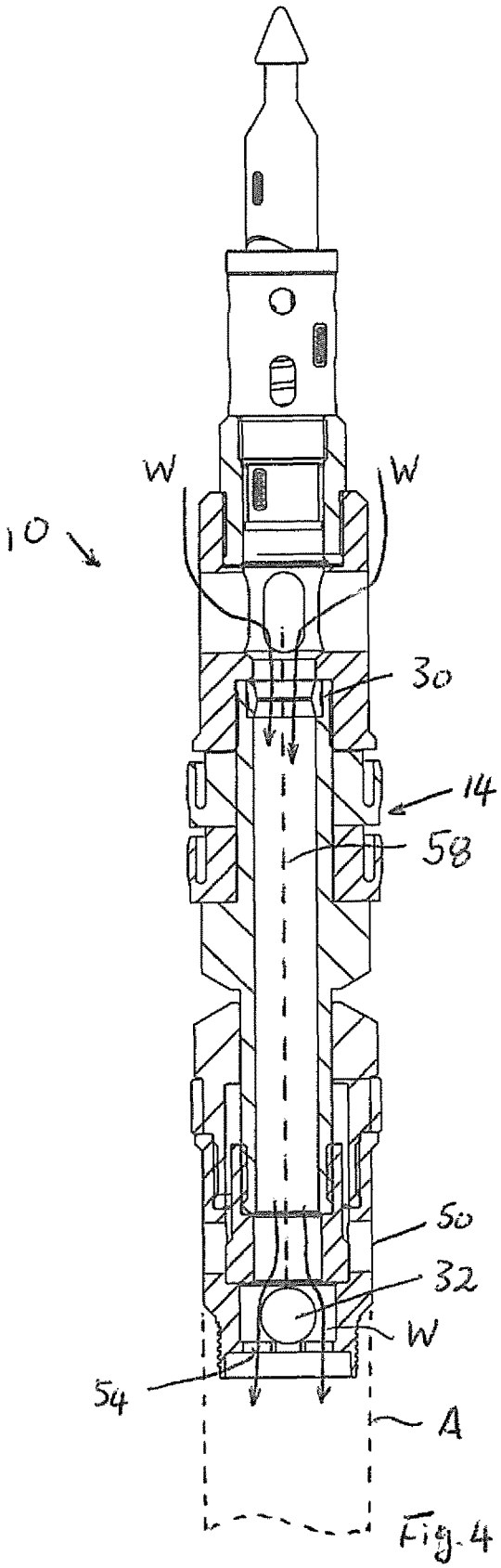
FIG. 4 is a section view of the device shown in FIG. 1 when in a bypass mode.

Eventually a downhole end of the apparatus A, or alternately a landing shoulder (not shown) of the device 10 lands on a lantern ring or other device (for example a drill bit) attached to or located within the drill string 12 halting any further travel of the device 10 and apparatus A down the drill string 12. This will be typically indicated to a drill rig operator by a decrease in flow rate of water into the drill string 12. The drill rig operator may now increase the water pressure to above the threshold pressure at which the valve mechanism 60 opens. At this pressure the valve ball 32 is forced or popped through the valve seat 30 and can travel through the body 13 landing on the wall 54. The configuration of the device 10 when in this condition is shown in FIG. 4. Here the first valve system 10 may be considered as being in a popped state where the valve ball 32 has passed through the valve seat 30.

The internal flow path 58 is now open and water W (or other liquids such as drilling mud) is able to flow through the device 10 bypassing the sealing mechanism 14 and into an upstream end of the A via the openings 56. Accordingly the fluid pressure can now operate the apparatus A to perform its intended function which in this example is to inject the flowable substance into the borehole.

Once a downhole operation has been performed by the apparatus A transported by the device 10 the ensemble can be retrieved by progressively reducing the fluid pressure gravity will cause the device 10 and apparatus A to float down the drill string 12.

Figure 5:
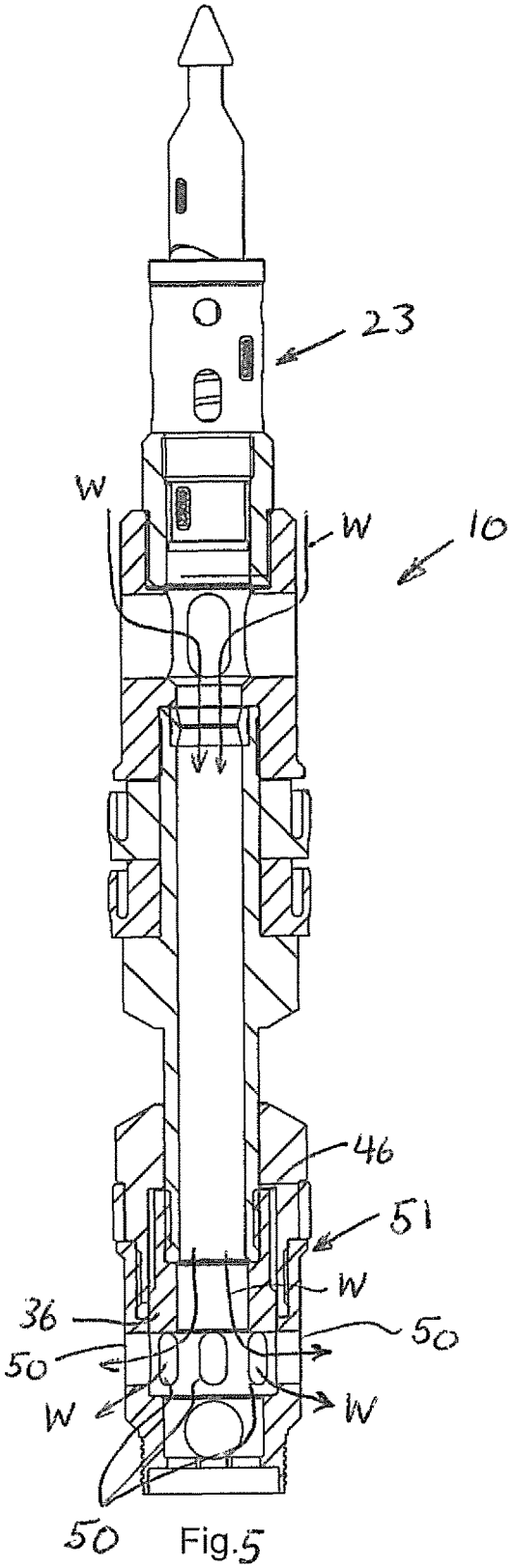
FIG. 5 is a section view of the device shown in FIG. 1 when in a retrieval mode.

There are several retrieval scenarios available for the device 10 depending on the gradient of the borehole/drill string 12. If the gradient is positive to zero, i.e. for boreholes that extend vertically downwardly to those which are horizontal or include horizontal portions, retrieval is via a wire line and overshot that connect to the spear point 23. Reeling in the wireline will cause the stem 18 and the sleeve 36 to slide axially in the up hole direction within the cap 40 until it engages the internal shoulder 46. When this occurs the sleeve 36 uncovers the second ports 50 thereby effectively opening the second valve system 51. This configuration is shown in FIG. 5. In this configuration water W up hole of the device 10 is able to flow through the internal flow path 58 and out of the ports 50 so that the wire line and associated winch does not bear the full weight of the head of water in the drill string 12.

Figure 8:
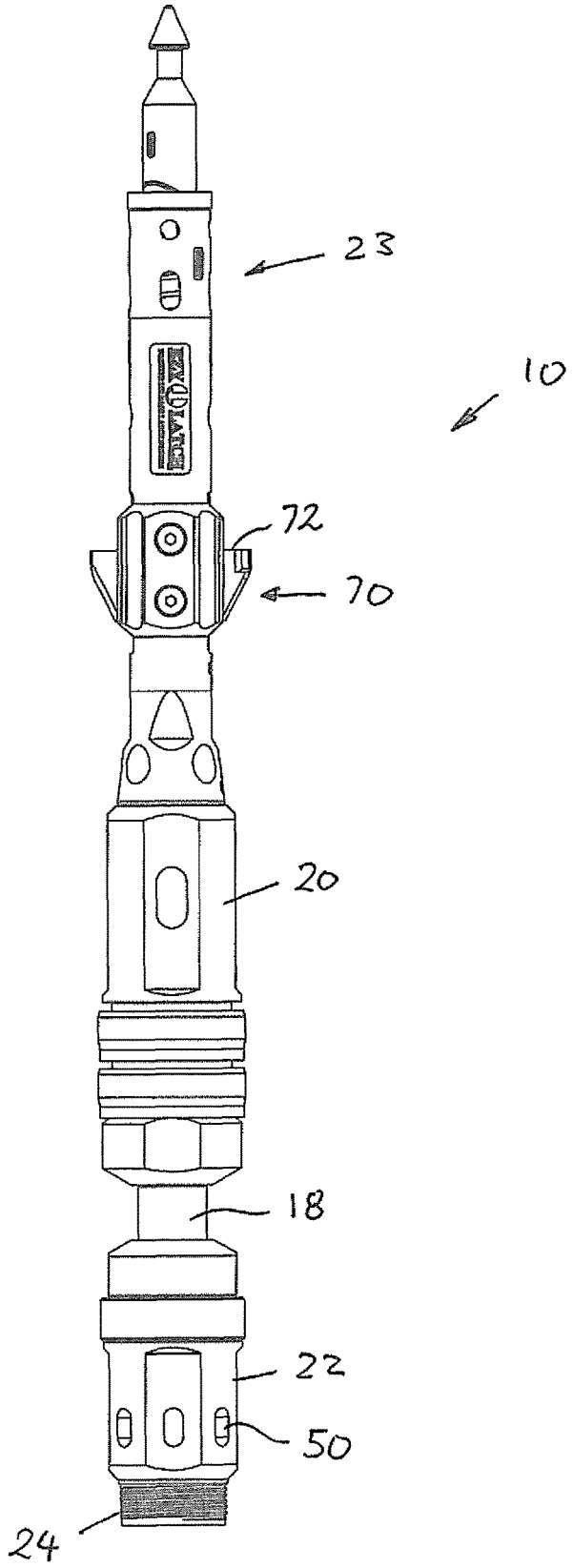
FIG. 8 is a schematic representation of the device shown in FIGS. 1-5 but modified with the addition of a latching system.

A further optional feature that may be incorporated in the device 10 when used in negative gravity gradient boreholes is a latch system 70 an example of which is depicted in FIG. 8. The latch system 70 may be incorporated in the spear point 23 or be connected in between the spear point 23 and the upper body 20.

The latch system 70 will interact with a latching shoulder (not shown) formed on an internal surface of the drill string 12. The latch system 70 may comprise a plurality of sprung latch dogs 72. The latching shoulder is located so that when the apparatus A engages a stop mechanism such as a drill bit at the downhole end of the string 12 the latch dogs 72 of the latch system 70 latches onto the latching shoulder. This has the effect of latching the entirety of the device 10 and the A at the downhole end of the drill string 12. Therefore if water pressure is reduced or shut off there is no risk of the device 10 and apparatus A sliding back down the drill string 12 in an uncontrolled manner without the knowledge of the drill operator which could otherwise cause significant damage to equipment and injury or death to an operator. A non-limiting example of one type of latching system 70 that can be used in this application is described in international publication number WO 2010096860 the contents of which is incorporated herein by way of reference.

When a latching system 70 is incorporated in the device 10 then an overshot on a wireline will be required to be pumped in drill string 12 to engage the spear point 140 to release the latching system enabling the retrieval of the device 10/apparatus A.

Free Fall Mode

The free fall mode shown in FIG. 3 is particularly well suited to use in drill string/boreholes ranging from horizontal down to about 35 degrees below the horizontal (sometimes referred to in the art as "flat holes") that would be too slow to rely on gravity to push the tool down to the core barrel, particularly if such so we would drill string also contained a volume of liquid. In this event liquid may also be pumped in from the top of the drill string 12 to provide motive force to push the device 10 and associated apparatus A along the drill string 12 to the downhole end. However the pressure of the liquid pumped in would roughly balance with the pressure of liquid downstream of the device 10 to maintain the ball 32 off the seat 30 enabling a flow through of the downstream fluid upwardly through the device 10 by the ports 50, flow path 58 and out of the ports 26.

Rapid Descent Mode

Figure 6:
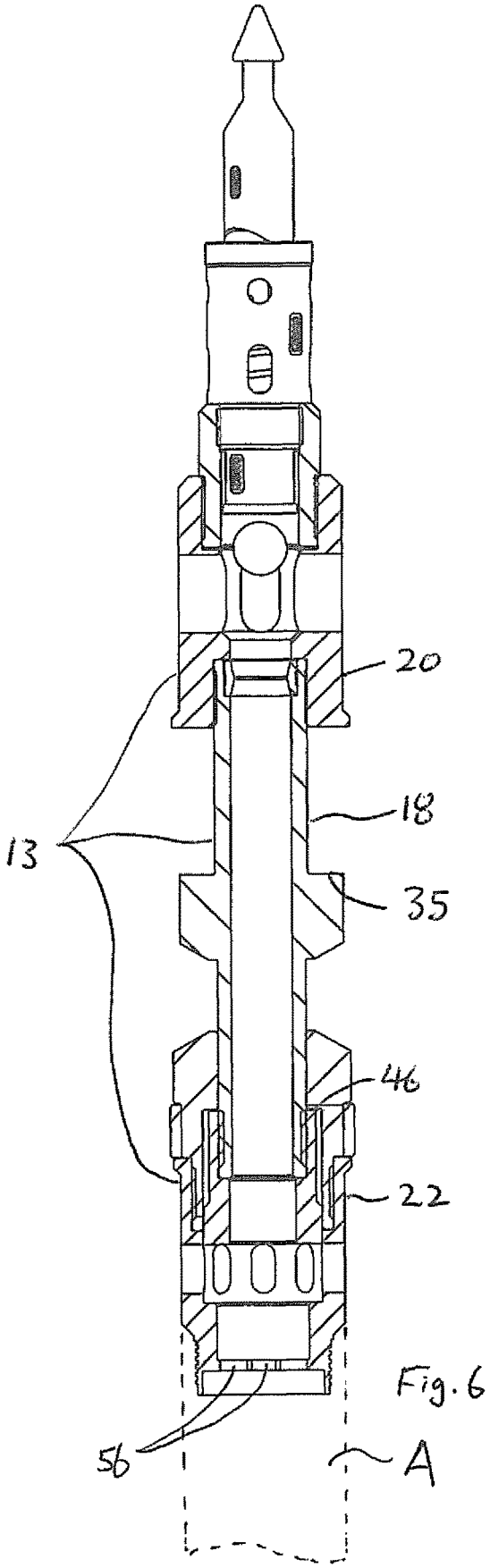
FIG. 6 is a section view of the device shown in FIG. 1 when in a rapid descent open mode characterised by an associated sealing mechanism being removed from the device.
Figure 7:
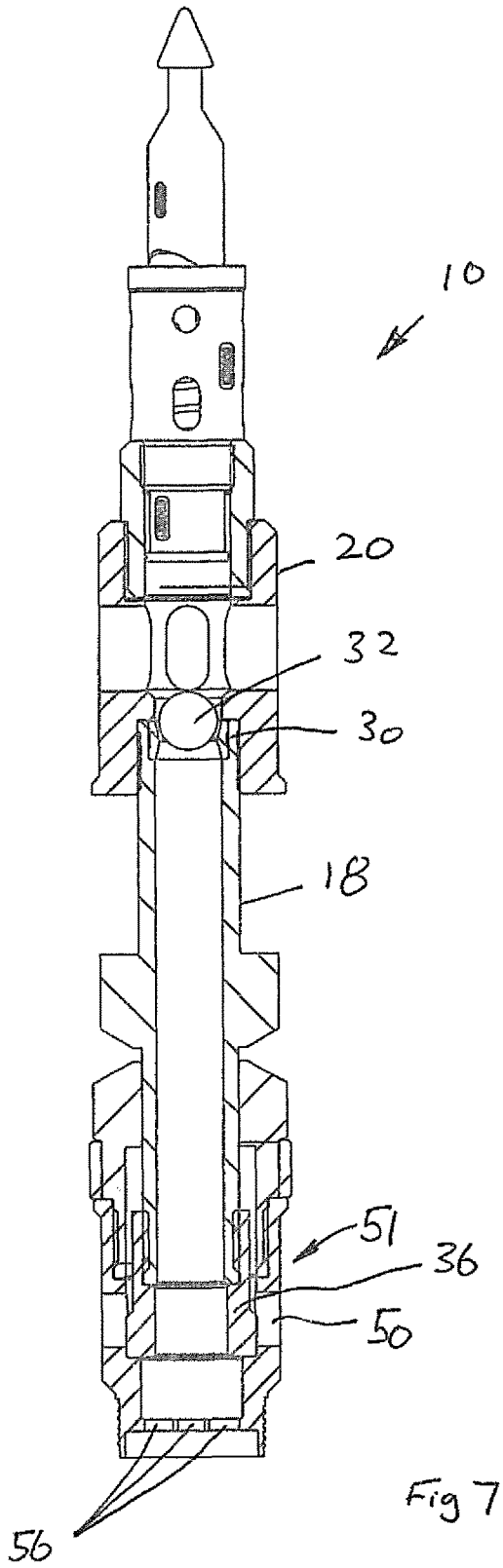
FIG. 7 is a section view of the device shown in FIG. 1 when in a rapid descent closed mode.

The rapid descent mode as shown in FIGS. 6 and 7 and is typically used for a positive gravity gradient hole in excess of 35° with course the maximum gradient being 90° and containing the water or other liquids. This mode is characterised by the sealing mechanism 14 being physically removed from the device 10 prior to deployment. In this regard the sealing mechanism 14 is demountably retained on the body 12. In particular the corresponding washers 16 can be removed by disconnecting (i.e. by unscrewing) the stem 18 from the upper body 20. An illustration of the device 10 with the sealing mechanism 14 removed are shown in FIGS. 6 and 7. Removing the sealing mechanism 14 speeds the rate of descent down the drill string 12 as water is able to bypass the relatively large outer diameter portions of the upper and lower body is 20 and 22 which would otherwise limit the rate of descent. In particular shown in FIG. 6 water is able to flow in through the ports 50 flow through the internal fluid path 58 and out of the ports 26.

FIG. 6 depicts the tool 10 in the rapid descent "open" mode where the valve all 32 is lifted from the seat 30 by the action of the flow-through of water W. FIG. 7 shows the tool 10 in the rapid descent "closed" mode which occurs at the moment the tool 10/apparatus A is seated at the downhole end of the drill string 12 and is unable to travel any further through the drill string 12. Here the upstream head of liquid acts on the valve ball 32 on its way to being pushed or popped wholly through the seat 30 to subsequently enable operation of the attached apparatus A by the communication of liquid or lick pressure through the holes 56.

The device 10 is described with reference to connection to and use with an apparatus A for delivering and injecting a flowable substance into a borehole. However the device 10 is not limited to such use. Rather the device 10 can be used to assist in the delivery and transport of in a downhole tool is equipment particularly when required to travel in a shallow or negative gravity gradient hole.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the method and system as disclosed herein.

The invention claimed is:

1. A device for facilitating the transport of an apparatus along an upward or downward directed conduit or bore hole comprising:

a body having a stem, an upper body portion and a lower body portion wherein the upper and lower body portions are coupled together by and at opposite ends of the stem and the upper and lower body portions are movable axially relative to each other;

the stem forming a fluid flow path internal of the body selectively enabling fluid to flow through the body; a first valve system located at a first end of the internal fluid flow path, the first valve system being operable by a pressure differential between a region external of the body and the internal fluid flow path;

a second valve system located at second end of the internal fluid flow path, the second valve system being operable by relative movement between the upper body portion and lower body portion, wherein the second valve system comprises one or more radial ports and a sleeve coupled to the upper body portion and slidably retained within the lower body portion, the sleeve movable to an open location where the sleeve uncovers the one or more radial ports to allow a flow of liquid there through, and a close location where the sleeve covers the one or more radial ports to prevent a flow of liquid there through; and one or more openings at an end of the body downstream of the first valve system through which fluid can flow or fluid pressure can be communicated to an apparatus being transported by the device.

2. The device according to claim 1 wherein the second valve system is arranged to close the one or more radial ports and the upper and lower body portions are moved relatively toward each other, and arranged to open the one or more radial ports when the upper and lower body portions are moved relatively away from each other.

3. The device according to anyone of claim 2 wherein the first valve system comprises a valve member a valve seat and wherein when the pressure differential is at a first level the valve member seats on one side of the valve seat to close the first valve system and when the pressure differential is at a second level greater than the first level the valve member is arranged to pass through the valve seat to an opposite side to open the first valve system enabling fluid to flow through the first valve system toward the one or more openings at the end of the body downstream of the first valve system.

4. The device according to claim 2 comprising a sealing mechanism removably connectable to the body and arranged to form a liquid seal between the device and a conduit or borehole through which the device travels.

5. The device according to claim 4 wherein the sealing mechanism is disposed on the body at location between the first valve system and the second valve system.

6. The device according to claim 1 wherein the first valve system comprises a valve member and a valve seat and wherein when the pressure differential is at a first level the valve member seats on one side of the valve seat to close the first valve system and when the pressure differential is at a second level greater than the first level the valve member is arranged to pass through the valve seat to an opposite side to open the first valve system enabling fluid to flow through the first valve system toward the one or more openings at the end of the body downstream of the first valve system.

7. The device according to claim 6 comprising a sealing mechanism removably connectable to the body and arranged to form a liquid seal between the device and a conduit or borehole through which the device travels.

8. The device according to claim 7 wherein when the pressure differential is at the second level and the second valve system is closed, liquid upstream of the sealing mechanism is able to flow through the internal flow path bypassing the sealing mechanism and flowing or communicating fluid pressure through the one or more openings at the end of the body downstream of the first valve system.

9. The device according to claim 1 comprising a sealing mechanism removably connectable to the body and arranged to form a liquid seal between the device and a conduit or borehole through which the device travels.

10. The device according to claim 9 wherein the sealing mechanism is disposed on the body at location between the first valve system and the second valve system.

11. The device according to claim 10 wherein when the pressure differential is at the second level, liquid upstream of the sealing mechanism is able to flow into the internal flow path by passing the sealing mechanism.

12. The device according to claim 9 wherein when the pressure differential is at the second level, liquid upstream of the sealing mechanism is able to flow into the internal flow path bypassing the sealing mechanism.

13. The device according to claim 12 wherein when the pressure differential is at the second level and the second valve system is closed, liquid upstream of the sealing mechanism is able to flow through the internal fluid flow path bypassing the sealing mechanism and flowing or communicating fluid pressure through the one or openings at the end of the body downstream of the first valve system.

14. The device according to claim 1 wherein the first valve system comprises a valve member and a valve seat and wherein when the pressure differential is at a first level the valve member seats on one side of the valve seat to close the first valve system and when the pressure differential is at a second level greater than the first level the valve member is arranged to pass through the valve seat to an opposite side to open the first valve system enabling fluid to flow through the first valve system toward the one or more openings at the end of the body downstream of the first valve system.

15. The device according to claim 14 wherein the sealing mechanism is disposed on the body at location between the first valve system and the second valve system.

16. The device according to claim 1 comprising a sealing mechanism removably connectable to the body and arranged to form a liquid seal between the device and a conduit or borehole through which the device travels.

* * * * *